US005121621A

United States Patent [19]

Ihly

[11] Patent Number: 5,121,621

[45] Date of Patent: Jun. 16, 1992

[54] PREFORMED FLANGE REFORMING PROCESS AND APPARATUS

[75] Inventor: Eugen F. Ihly, Denver, Colo.

[73] Assignee: Ihly Industries, Inc., Englewood, Colo.

[21] Appl. No.: 658,076

[22] Filed: Feb. 20, 1991

[51] Int. Cl.[5] ..... B21D 19/04

[52] U.S. Cl. ..... 72/126; 72/379.4

[58] Field of Search ..... 72/118, 119, 115, 117, 72/124, 126, 379.4; 413/69

[56] References Cited

U.S. PATENT DOCUMENTS

| | | | |
|---|---|---|---|
| 2,156,237 | 4/1939 | Draper | 220/39 |
| 2,335,260 | 11/1943 | Chamberlain | 220/74 |
| 3,344,647 | 10/1967 | Berger | 413/69 |
| 3,418,837 | 12/1968 | Vanderlaan et al. | 72/94 |
| 3,469,428 | 9/1969 | Aschberger | 72/94 |
| 3,498,245 | 3/1970 | Hansson | 72/126 |
| 3,503,239 | 3/1970 | Hansson | 413/69 |
| 3,688,538 | 9/1972 | Hoyne | 72/94 |
| 3,754,424 | 8/1973 | Costanzo | 72/105 |
| 3,998,174 | 12/1976 | Saunders | 113/120 |
| 4,058,998 | 11/1977 | Franek et al. | 72/84 |
| 4,070,888 | 1/1978 | Gombas | 72/91 |
| 4,102,168 | 7/1978 | Brookes et al. | 72/117 |
| 4,341,103 | 7/1982 | Escallon et al. | 72/70 |
| 4,487,048 | 12/1984 | Frei | 72/94 |
| 4,512,172 | 4/1985 | Abbott et al. | 72/68 |
| 4,563,887 | 1/1986 | Bressan et al. | 72/84 |
| 4,578,007 | 3/1986 | Diekhoff | 413/6 |
| 4,606,207 | 8/1986 | Slade | 72/96 |
| 4,732,027 | 3/1988 | Traczyk et al. | 72/133 |
| 4,781,047 | 11/1988 | Bressan et al. | 72/84 |
| 4,870,847 | 10/1989 | Kitt | 72/84 |

FOREIGN PATENT DOCUMENTS

| | | |
|---|---|---|
| 602423 | 7/1978 | Switzerland . |
| 2092492 | 8/1982 | United Kingdom . |

OTHER PUBLICATIONS

Publication by Metal Box Engineering (unknown publication date).

*Primary Examiner*—Lowell A. Larson

*Attorney, Agent, or Firm*—Sheridan, Ross & McIntosh

[57] ABSTRACT

A process and apparatus for resizing the throat of a cylindrical container and simultaneously reforming a preformed flange on an open end of such container. In one embodiment, the throat of the container is resized by applying an outward force to the throat to increase the diameter thereof. Moreover, the preformed flange is forced radially outward. However, the outward radial movement of at least a portion of an outer edge of the preformed flange is restrained during such resizing. As a result, at least portions of the preformed flange flex between the throat and the restrained portion of the outer edge. These flexed portions project to differing degrees and at least a portion of this projecting flexure is maintained after the reforming process to improve flange uniformity.

19 Claims, 6 Drawing Sheets

PREFORMED FLANGE REFORMING PROCESS AND APPARATUS

FIELD OF THE INVENTION

This invention relates generally to the field of forming cylindrical containers and, more particularly, to resizing the throat on an open end thereof while reforming a preformed flange positioned on the open end by restraining the outward, radial movement of at least portions of the flange, resulting in improved flange width and uniformity.

BACKGROUND OF THE INVENTION

There are a wide variety of cylindrical containers constructed from different materials and in different configurations to accommodate a wide variety of uses. Notwithstanding such variety, metal containers can be generally categorized as either two-piece or three-piece. Two-piece containers are typically manufactured by a drawing and ironing process to produce a container having a continuous bottom and sidewall to which a separate end piece is connected. Three-piece containers are typically manufactured from metal roll stock that is cut into strips having a width that will substantially define the height of the resultant container and a length which will effectively define its diameter. Each strip is then formed into a cylindrical shape and the opposing edges of the strip are attached by processes known in the art, such as welding. With this type of construction, two end pieces must be separately attached to the cylinder to form a closed container.

Whether construction is achieved by two- or three-piece methods, a key portion of the construction process relates to attachment of at least one end piece to the container. In this regard, a flange is typically formed on the open end(s) of the container to receive an end piece. The flange, which is most often a continuation of the sidewall of the container, is formed to yield the desired angular relationship for mating end piece connection.

One method often used to secure an end piece to a preformed flange is known as curling. An end piece, typically having a hooked outer edge, is placed on the flanged end(s) of the container. After properly positioning the end piece, the flange and the end piece are curled together to form the seal. FIG. 1 illustrates a typical seal formed in this fashion on a typical container with A being the end piece, B being a sidewall, and C being the flange.

Regardless of the method employed to secure an end piece to a container, it is important to have a flange of sufficient width and uniformity in order to achieve an acceptable seal. Due to the manner in which flanges are typically formed, however, such as by using various dies and/or forming rollers, desired tolerances for flange width and uniformity can be difficult to achieve.

Satisfaction of flange width and uniformity requirements can be further hindered when additional container forming processes, such as necking, are performed in the flange region. Necking processes often entail inwardly cold working a container sidewall wherein axial progression is non-synchronous about the periphery of the container. For example, in spin flow forming processes, an outer forming roller is employed to neck and at least partially form a flange on a container sidewall by inwardly working a rotating container in a spiral fashion. As will be appreciated by those skilled in the art, such necking can, depending upon the inward extent thereof, contribute to flange non-uniformities and resultant end-piece sealing difficulties.

SUMMARY OF THE INVENTION

In accordance with the present invention, a process and apparatus are provided for resizing the throat of a cylindrical container having a preformed flange and, at least at some point, simultaneously reforming the preformed flange. The invention generally entails increasing the diameter of an axial portion of the throat of the cylindrical container in an axially progressive manner from the open end, while limiting the resultant outward radial movement of the preformed flange edge. As a result of the simultaneous throat resizing/preformed flange reforming operations, flange width and uniformity is improved. Concomitantly, the circularity of the outer edge of the flange is improved, as well as the peripheral concentricity of the throat with respect to the flange.

As used herein, the term "preformed flange" means a flange formed prior to application of the present invention which bears an upward angular relationship to the sidewalls and longitudinal axis of a container. Such angle should preferably be within the range of about 20°–70°, but the invention is not so limited. Angles within the preferred range can be achieved, for example, by employing a controlled spin flow necking process, as disclosed in U.S. Pat. Nos. 4,563,887 and 4,781,097.

Further, as used herein, the term "throat" means any axial portion of a container near an open end thereof having an inner diameter less than the desired outer diameter of a flange formed at such end. In typical applications of the present invention, the "throat" portion is immediately adjacent to the flange. The inner diameter of such region is often referred to as the "plug diameter" in the context of sealing processes.

The present invention is performed with an apparatus which in one embodiment includes an outer mounting assembly and an inner mounting assembly. The inner mounting assembly is substantially contained within the outer mounting assembly and is able to freely rotate with respect thereto. A first drive mechanism is attached to the inner mounting assembly to rotate the inner mounting assembly about its rotational axis while a second drive mechanism imparts linear motion to both the outer mounting assembly and the inner mounting assembly during the throat resizing/preformed flange reforming process. Of course, one mechanism may be used to supply both of the above-noted rotary and linear motions The outer mounting assembly has a front facing, a major portion of which has an opening extending therethrough to the inner mounting assembly. Inner rollers rotatably attached to the inner mounting assembly extend through the opening and act as the mechanism which resizes the diameter of a desired portion of the throat, which also allows for reforming of the preformed flange, as will be discussed below. These inner rollers are substantially concentrically positioned about the rotational axis of the inner mounting assembly which is itself substantially aligned with the longitudinal axis of the cylindrical container.

When the inner mounting assembly is rotated and the apparatus is linearly advanced relative to the cylindrical container, the inner rollers contact the inner surface of the cylindrical container. To facilitate entry into the throat of the container, the contour of the leading portion of each of the inner rollers is tapered toward the central axis of such rollers. A diameter defined by a circle tangent to points on the outermost surfaces of the inner rollers at this inwardly tapered leading portion is thus established to be slightly smaller than the diameter of the container throat to be resized to allow for entry therein. The balance of the leading tapered portions and further tapered portions of the inner rollers collectively define an increasing diameter to achieve the desired degree of throat resizing, as will be further described. As a result of the general shape of the inner rollers and the movement thereof relative to the cylindrical container (i.e., rotational, both freely on the inner container surface and drivenly by the inner mounting housing, and linearly into the container), the throat is resized by using a force having both axial and radial components.

Positioned radially and concentrically outward from the base of the inner rollers, as a part of the outer mounting assembly, is a radial restraining means which at some point during throat resizing limits the outward radial movement of the preformed flange edge resulting from the throat resizing. Such radial limitation is necessary to improve flange width and uniformity, and contributes to improved flange/throat circularity and concentricity in the present invention.

In one embodiment, the radial restraining means is a ring defining the opening in the front facing of the outer mounting assembly, the ring being substantially circular, substantially concentric with respect to the rotational axis of the inner mounting assembly, and having a surface for engaging the flange edge which is substantially parallel to the rotational axes of the inner rollers.

As will be appreciated, improved flange width and uniformity is, in large part, achieved in the present invention due to the preformed condition of the flange upon engagement with the radial restraining means. The preformed condition results in an upwardly angular interface between the preformed flange edge and radial restraining means during the throat resizing/-preformed flange reforming process, thereby allowing for upward flange flexure to varying degrees about the flange periphery. That is, wider portions of the flange can flex to a greater extent than narrower portions. Such upward flexure, or bulging, is at least partially retained by the flange subsequent to application of the invention so as to improve flange width and uniformity. As a further result of such flexure, together with the axial progression of the radial restraining means during throat resizing/preformed flange reforming, it is possible to achieve a downward orientation of the flange edge relative to the radial restraining means to further contribute to improved flange uniformity. The axial progression of the radial restraining means may, of course, also contribute to the described flange flexure, as well as any desired increase in the ultimate overall flange angle relative to the container center axis. In the latter regard, it should be appreciated that the present invention can, in addition to the previously noted advantages, bend the preformed flange down to render the container flange ready for direct end-piece securement (e.g., by disposing the flange near normal to the container center axis for curling of an end-piece as shown in FIG. 1).

For purposes of accommodating the desired upward flexure and deflecting the preformed flange edge towards the radial restraining means during the throat resizing/preformed flange reforming process, as necessary, an axial restraining means can also be provided. In one embodiment, such axial restraining means is defined by radially-extending, skirt-like portions at the bases of the inner rollers. Such portions extend radially outward towards the radial restraining means and are preferably continuously interfaced with the inner roller tapered portions through a smooth radius sufficient to accommodate the desired flexure.

In one embodiment of the present invention, a container having an open end with a preformed flange is positioned stationary and in axial alignment relative to the inventive apparatus. Rotary motion is then imparted to the inner mounting assembly and linear motion is imparted to the entire apparatus such that the leading tapered portions of the inner rollers contact the interior surface of the throat of the container. Since the inner rollers are positioned substantially concentrically about the rotational axis of the inner mounting housing and since such rotational axis is substantially aligned with the longitudinal axis of the cylindrical container to be reformed, the inner rollers will initially act to improve any circularity non-uniformities in the throat region upon contact therewith. As the inner rollers freely rotate on and relative to the inner surface of the container, the apparatus moves the rollers inwardly to resize the desired throat region. The extent of progressive inward axial movement and roller length will of course depend upon the proximity of the throat region to the open end, as well as the extent of throat and flange non-uniformity to be addressed. Due to the above-described tapered contour of the inner rollers, the inward movement of the inner rollers causes an increase in the throat diameter by exerting an axial and radial force thereupon.

As the tapered inner rollers are further inserted into the container to cause outward radial movement of the preformed flange, the portions of the outer edge corresponding with the wider portions of the preformed flange will progressively contact the radial restraining means and such flange portions will flex upward to varying degrees to achieve the desired flange reformation. As noted, the overall flange angle relative to the container may also be increased as the radially restraining means progresses axially, and the outer edge of the flange may turn slightly downward adjacent to the radial restraining means after engagement therewith, thereby further contributing to improved flange uniformity.

During rotation of the concentrically positioned inner rollers, the radial restraining means serves to improve the circularity of the outer edge of the flange by restraining wider portions of the flange while allowing narrower portions of the flange to reach or at least approach the radial restraining means before cessation of the throat resizing/preformed flange reforming operations. Since the axis of the inner mounting assembly and the radial restraining device are substantially coaxial, the peripheral concentricity of the flange edge relative to the throat by simultaneous performance of the throat resizing and flange restraining processes can be improved, as well as flange uniformity.

DETAILED DESCRIPTION

The present invention will be described with reference to FIGS. 2–10. The embodiments shown therein have the ability to: improve the outer circularity of a preformed flange; increase the diameter and improve circularity of a container throat; improve the peripheral concentricity of the throat with respect to the peripheral edge of flange; and to improve the uniformity and width of the flange.

Figure 2:
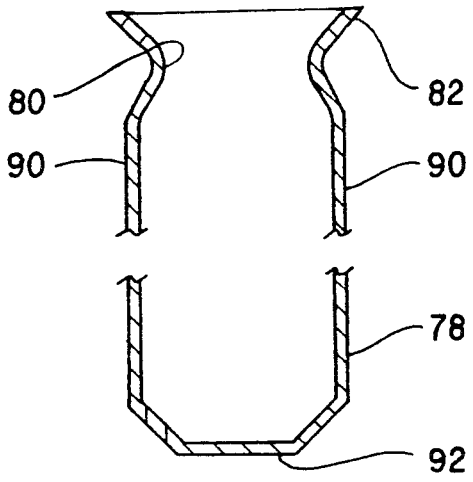
FIG. 2 is a cross-sectional view of a necked container having a preformed flange that can be reformed employing the present invention.

FIG. 2 illustrates a container 78 having a throat 80 and preformed flange 82 which may be resized/reformed using the process and apparatus of the present invention. Container 78 is of the two-piece construction type detailed above having a sidewall 90 and an integrally formed bottom 92 and which has been necked-in, for example, by controlled spin flow forming processes of the type described in U.S. Pat. Nos. 4,563,887 and 4,781,047. As will be appreciated by those skilled in the art, preformed flanges on unnecked and three-piece containers may also be reformed using the present invention.

Figure 3:
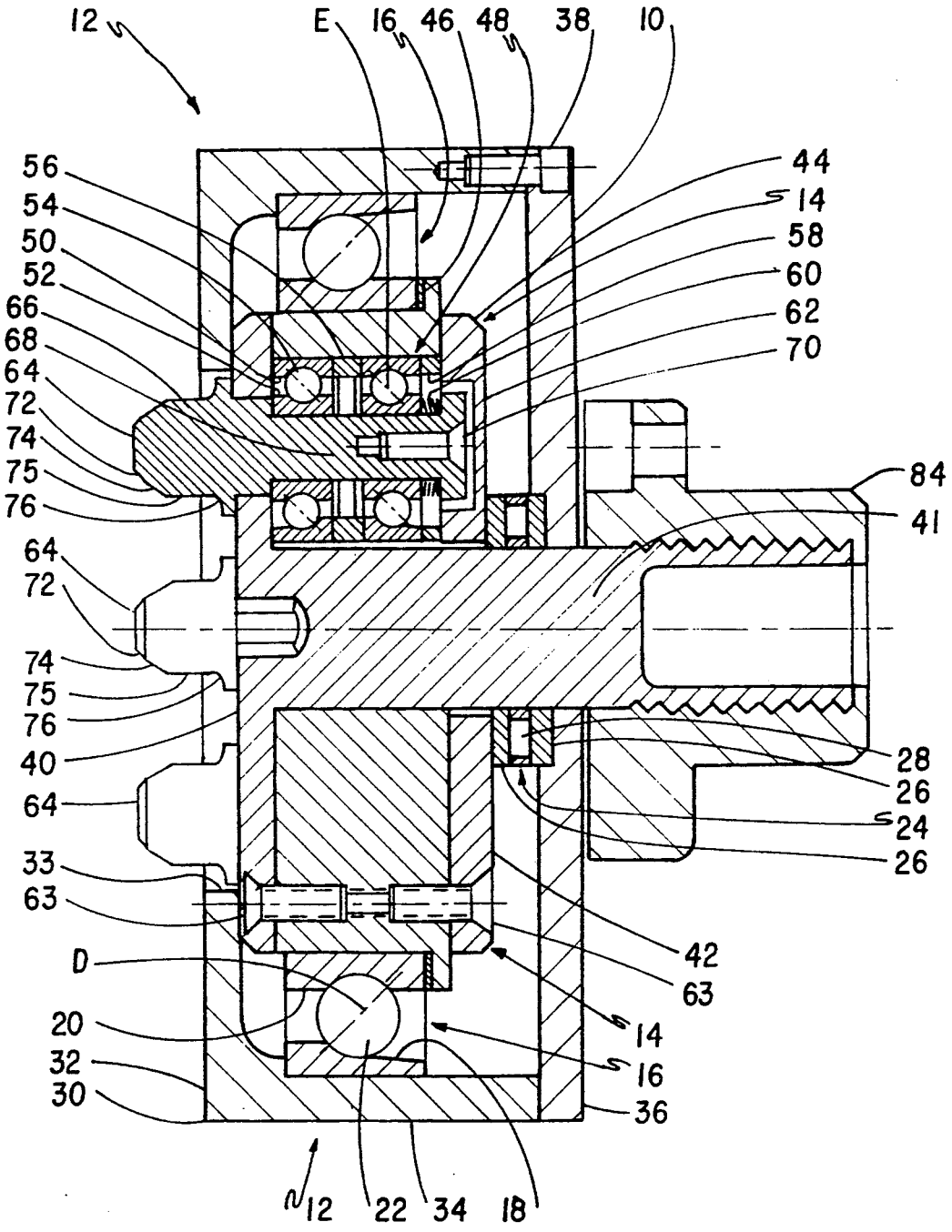
FIG. 3 is a cross-sectional side view of an embodiment of an apparatus of the present invention.

FIG. 3 is a cross-sectional view of one embodiment of the inventive throat resizing/preformed flange reforming apparatus 10. This embodiment includes an outer mounting assembly 12 and an inner mounting assembly 14. Inner mounting assembly 14 is substantially contained within outer mounting assembly 12 and is able to rotate with respect thereto and independently therefrom. In this regard, first bearing assembly 16 is radially positioned between outer mounting assembly 12 and inner mounting assembly 14 to reduce friction therebetween and second bearing assembly 24 is axially positioned therebetween to also reduce friction. Preferably, inner mounting assembly 14 rotates with respect to a substantially stationary outer mounting assembly 12. However, inner mounting assembly 14 and outer mounting assembly 12 may also both rotate in an alternative embodiment of the present invention.

First bearing assembly 16, which radially separates outer mounting assembly 12 and inner mounting assembly 14, comprises first outer sleeve 18, the outer surface of which contacts outer mounting assembly 12, first inner sleeve 20, the outer surface of which contacts inner mounting assembly 14, shim 46 which is partially placed therebetween, and a plurality of first rolling members 22 which are positioned to contact the interior surfaces of first outer sleeve 18 and first inner sleeve 20 to reduce friction therebetween and to provide radial support. Preferably, first bearing assembly 16 is of a type commonly referred to in the art as a single row, angular-contact ball bearing. Such bearings are designed to support combined radial and axial loads. Consequently, first rolling members 22 are shown in FIG. 3 as having such an inclined axis D.

Second bearing assembly 24 is also positioned between outer mounting assembly 12 and inner mounting assembly 14 to absorb axial forces transferred therebetween. Second bearing assembly 24 comprises thrust washers 26 and thrust bearing 28.

Figure 5:
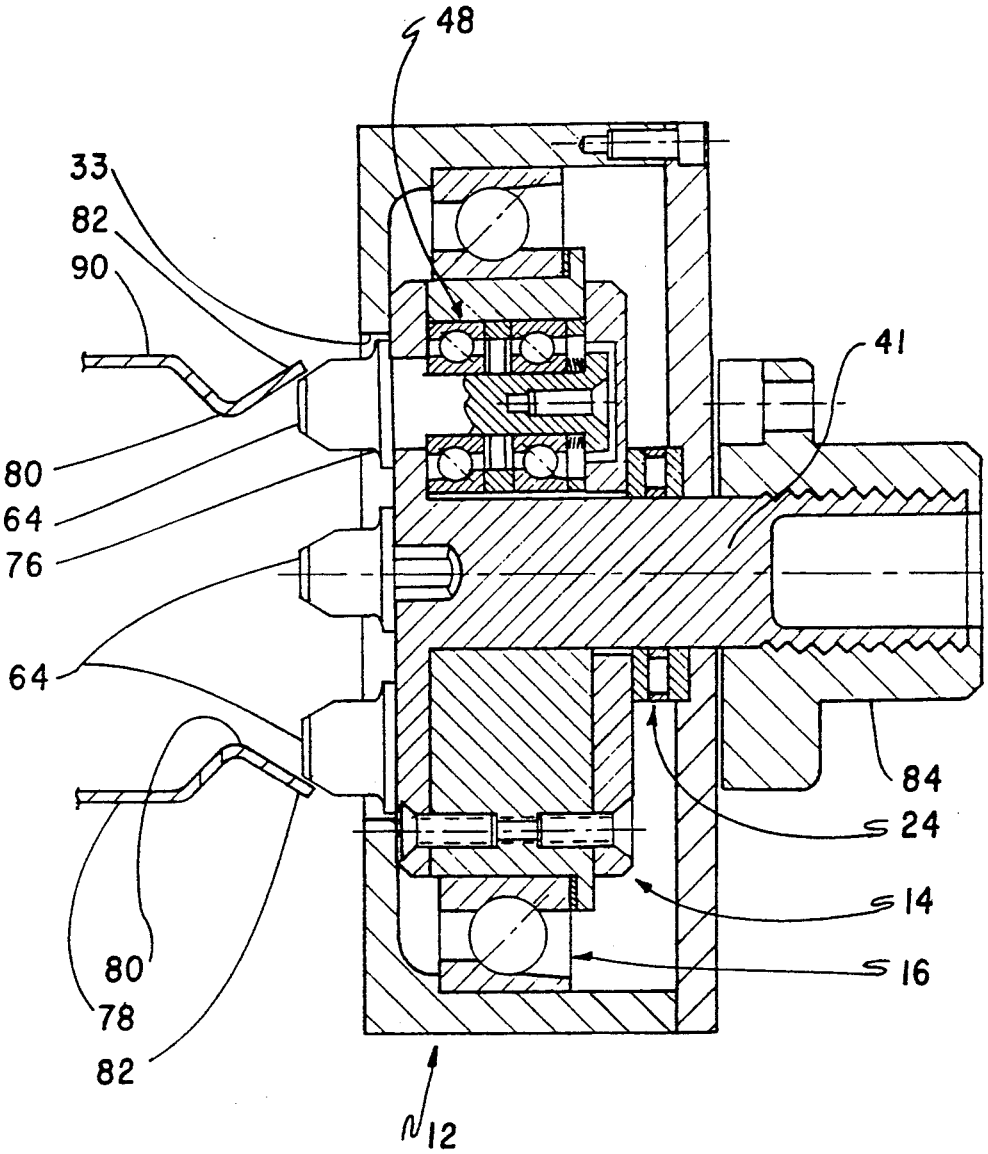
FIG. 5 is a cross-sectional side view of an embodiment of the inventive apparatus partially inserted into a necked container having a preformed flange.

As previously stated, inner mounting assembly 14 is capable of rotating relative to outer mounting assembly 12. In this regard, shaft 41 of inner mounting assembly 14 is secured to a driving means (not shown) by adapter 84. This driving means imparts rotation to shaft 41 which causes inner mounting assembly 14 to rotate about the axis defined by shaft 41. Furthermore, apparatus 10 is capable of travelling in a linear, or axial, fashion by a second drive means (not shown). Preferably, inner mounting assembly 14 rotates while apparatus 10 moves linearly toward a substantially stationary cylindrical object 78 (FIG. 5). However, relative rotation and lineal advancement are the only limitations imposed by the present invention in this regard and thus cylindrical object 78 may in fact rotate and linearly advance toward a substantially stationary inner mounting assembly 14 and apparatus 10 in another embodiment of the present invention. Moreover, one drive mechanism can be used to provide both the rotary and linear motion.

Outer mounting assembly 12 generally comprises radial restraining ring housing 30 and backing plate 36. Radial restraining ring housing 30 and backing plate 36 are fixedly secured together by a plurality of first cap screws 38 (only one shown in FIG. 3). Radial restraining ring housing 30 includes a restraining ring face 32 and restraining ring sides 34. The central region of radial restraining ring face 32 has an opening therethrough allowing portions of inner mounting assembly 14 to be exposed in a manner which will be discussed below in greater detail. In one embodiment, the edges of the opening in the radial restraining ring face 32 also define a radial restraining ring 33 which limits the outward radial movement of the preformed flange 82 of cylindrical object 78 during resizing of the throat 80 as will be discussed below (FIG. 5). In this regard, the opening in restraining ring face 32 is substantially circular and concentric with respect to the rotational axis of shaft 41 such that the radial restraining ring 33 will contribute to improvement in flange circularity, flange/throat concentricity, and flange uniformity and width.

Positioned between radial restraining ring housing 30 and backing plate 36 of outer mounting assembly 12 is inner mounting assembly 14. As previously stated, outer mounting assembly 12 and inner mounting assembly 14 are radially separated and radially supported by first bearing assembly 16 and axially separated and axially supported by second bearing assembly 24. Inner mounting assembly 14 is generally comprised of front retaining plate 40, back retaining plate 42, and roller housing 44 which is positioned therebetween. A plurality of second cap screws 63 (only two shown) secure inner mounting assembly 14 in this manner. Shaft 41 is integrally connected to front retaining plate 40 and is used as the means, together with adapter 84 impart rotation to inner mounting assembly 14.

The primary function of inner mounting assembly 14 is to support a plurality of inner rollers 64 which are used in the throat resizing/preformed flange reforming process of the present invention. The stem 68 of each inner roller 64 is supported by a third bearing assembly 48 which is substantially retained within roller housing 44. Third bearing assembly 48 generally comprises third outer sleeve 50, the outer portion of which contacts an inner surface of roller housing 44, third inner sleeve 52, a portion of which contacts stem 68 of inner rollers 64, and a plurality of third rolling members 54 which are positioned between third outer sleeve 50 and third inner sleeve 52 to reduce friction therebetween and to support inner rollers 64. Again, as with first bearing assembly 16, preferably third bearing assembly 48 is of the type commonly referred to as a single roll, angular-contact roller bearing. Consequently, third rolling members 54 are shown in FIG. 3 as having an inclined axis E. Preferably there are two (2) third bearing assemblies 48 contained within roller housing 44. In this double-bearing configuration, middle spacer 56 separates the two third bearing assemblies 48. Furthermore, end spacer 58 separates third outer sleeve 50 of the lowermost third bearing assembly 48 from back retaining plate 42. Furthermore, disc springs 60 separate third inner sleeve 52 of the lowermost third bearing assembly 48 from back retaining plate 42. Disc springs 60 allow inner rollers 64 limited linear travel during use to accommodate for slightly differing conditions during the performance of the processes of the present invention.

A plurality of third cap screws 70 (one shown) connect the shafts 68 of the plurality of inner rollers 64 to back retaining plate 42. Since apparatus 10 is capable of linear motion and in fact does so when resizing/reforming a cylindrical object 78 (FIGS. 6–10), thrust collar 62 is positioned adjacent to the bottom of stem 68 of inner rollers 64 to absorb axial loads imparted upon inner rollers 64 when performing the processes of the present invention. Further in this regard, second bearing assembly 24 is positioned between backing plate 36 of outer mounting assembly 12 and back retaining plate 42 of inner mounting assembly 14 to again assist in absorbing axial loads imparted upon apparatus 10 during operation.

Figure 1:
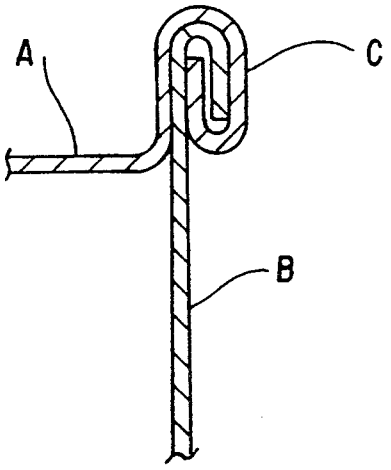
FIG. 1 (PRIOR ART)
FIG. 1 is a cross-sectional view of a typical prior art seal formed between an end piece and a container flange by a typical curling method.
Figure 4:
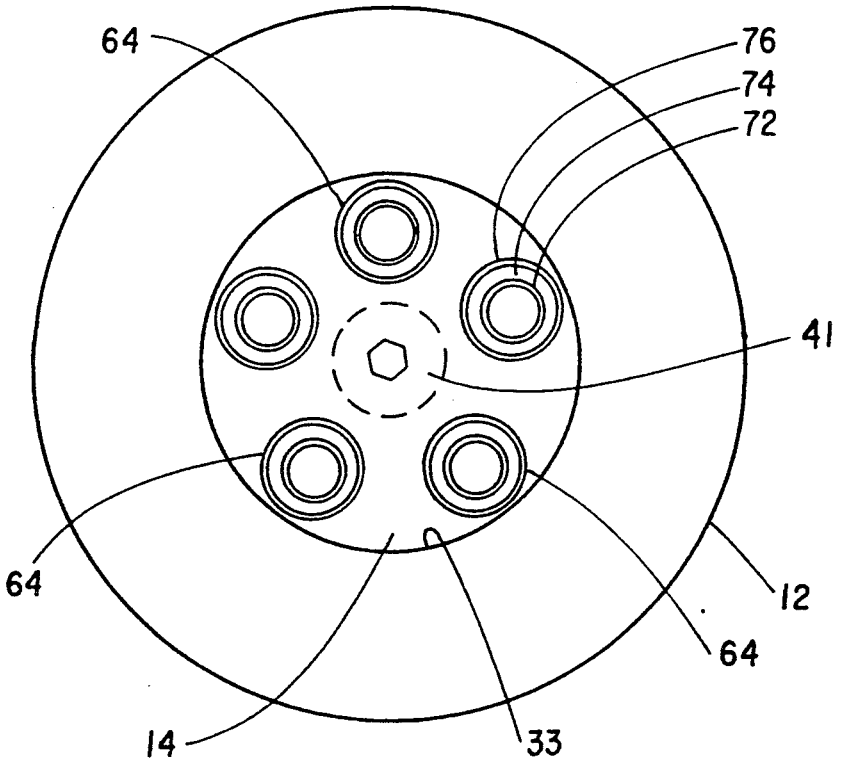
FIG. 4 is a bottom view of the apparatus of FIG. 3 illustrating a plurality of inner rollers.

As previously addressed, the primary function of inner mounting assembly 14 is to support inner rollers 64. As best seen in FIG. 4, a plurality of inner rollers 64 are substantially concentrically positioned about the rotational axis of inner mounting assembly 14. Five inner rollers 64 are illustrated in FIG. 4, but any number which will effectively perform the functions of the present invention can be employed. The outermost surfaces of inner rollers 64 are spaced from radial restraining ring 33 in the embodiment shown in FIG. 4. Therefore, inner rollers 64 are able to freely rotate with inner mounting assembly 14 without being restricted by outer mounting assembly 12 or radial restraining ring 33.

Since the process of the present invention is used to resize the throat 80 and simultaneously produce a more uniform diameter of a preformed flange 82 on a cylindrical object 78 (FIG. 5), and since inner rollers 64 are important elements used in such throat resizing/-preformed flange reforming processes, the outer surfaces of inner rollers 64 are important to proper operation of the present invention. Referring to FIGS. 3 and 6–10 which illustrate one embodiment of the inner rollers 64, each inner roller 64 is generally comprised of body 66 and stem 68 which is supported by third bearing assembly 48. The body 66 of inner rollers 64 is contoured to allow apparatus 10 to perform the above-stated functions. In order to ensure entry into the cylindrical object 78 (FIG. 5), each inner roller 64 has a first tapered surface 72, with the diameter increasing from the tip to the base 76, which initially contacts the throat 80 of a cylindrical object 78. The diameter of a circle tangent to the outermost surface of the forwardmost portion of the first angled surface 72 of the plurality of inner rollers 64 is slightly smaller than the inner diameter of the throat 80. Consequently, when apparatus 10 is linearly advanced toward cylindrical object 78, each of the plurality of inner rollers 64 will initially come within the throat 80.

Following first tapered surface 72 on each inner roller 64 is second tapered surface 74, which increases in diameter toward the base 76. In the embodiment shown in FIGS. 6 through 10, first and second tapered surfaces 72 and 74 act to increase the diameter of the throat 80 of cylindrical object 78 when the surfaces 72 and 74 are inserted within sidewall 90. While the angulation of surfaces 72 and 74 will, in part, determine the rapidity of the throat resizing, the present invention is not limited to use of two tapered portions of differing degrees. Transition portion 75 follows second tapered surface 74, and in one embodiment is substantially parallel with respect to the rotational axes of inner rollers 64 to provide inner support for the resized throat 80 during later stages of the process and/or to limit snapback of the sidewall 90 in the region of the throat 80 after having been resized.

As best illustrated in FIGS. 6–10, the bases 76 of the inner rollers 64 preferably are of a skirt-like configuration with a smooth radius adjoining transition portion 75. In such embodiment, the bases 76 extend radially outward towards the radial restraining ring 33, and serve to accommodate upward flange flexure during throat resizing/preformed flange reforming. Further, in applications where, for example, the preformed flange 82 has a more upward angulation than that shown in FIGS. 6–10, the inner roller bases 76 can serve to deflect, as necessary, the edge of the preformed flange 82 towards the radial restraining ring 33 for reforming.

The degree of upward angulation of the preformed flange 82 with respect to the longitudinal axis of the cylindrical object 78 may range between zero to ninety degrees, but preferably it will range from about twenty degrees (20°) to about seventy degrees (70°). The initial degree of angulation of the preformed flange 82 will, in part, determine the degree of flange non-uniformity that can be addressed. That is, as the degree of non-uniformity increases, there is a need to accommodate greater resultant flexure of the preformed flange 82 which may occur by taking into account the initial flange angulation, the spacing relationship between the radial restraining ring 33 and the inner rollers 64, and as necessary, the contour of the bases 76 of the inner rollers 64.

In operation of the apparatus 10, container 78 is securely positioned by engagement with a mechanical or vacuum device to the bottom 92 or other suitable location on the container 78. When properly positioned, throat 80 of cylindrical object 78 will be substantially concentrically aligned with the rotational axis of inner mounting assembly 14.

Apparatus 10 is then axially advanced toward throat 80 of container 78 by a drive mechanism (not shown). Prior to inner rollers 64 contacting the inner surfaces of throat 80, a second drive means (not shown) is activated to impose rotary motion to shaft 41 which thus rotates inner mounting assembly 14. Contact between the container throat 80 and inner rollers 64 causes the free rotation of stems 68 of inner rollers 64. As previously stated, the present invention requires only that there be relative motion between inner mounting assembly 14 (and each inner roller 64) and container 78, (i.e., cylindrical object 78 could rotate and linearly advance toward a substantially stationary inner mounting assembly 14 in another embodiment of the present invention). Moreover, one drive means (not shown) may provide both the rotary and lineal motions required for operation of the present invention.

Figure 6:
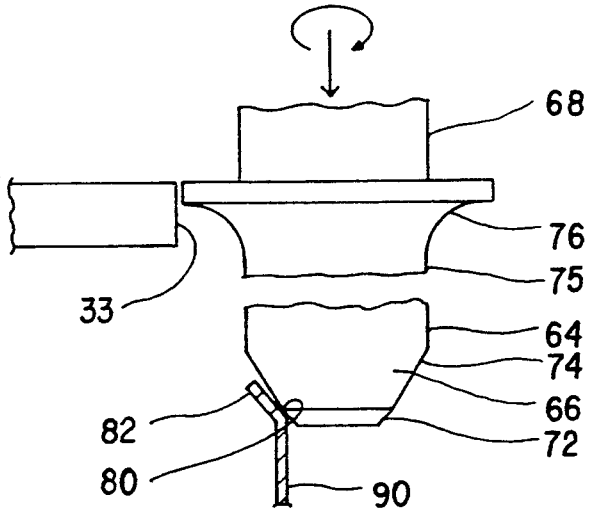
FIG. 6 is an enlarged side view of an embodiment of an inner roller of the present invention after it has inwardly advanced into a necked container to establish contact of a first tapered surface thereof with the throat of the container.
Figure 6:
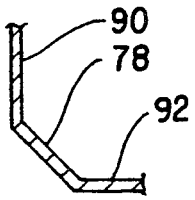
Figure 7:
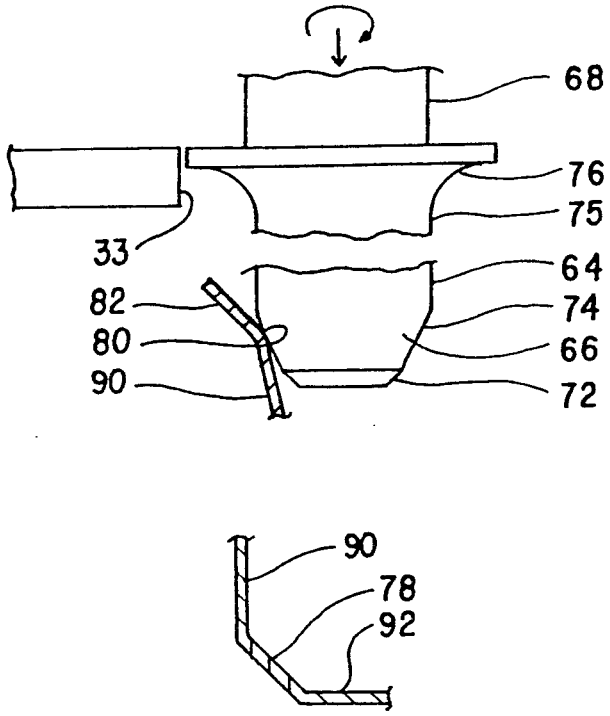
FIG. 7 is an enlarged side view of the inner roller after it has inwardly advanced into the necked container to establish contact of a second tapered surface thereof with the container throat.

The subsequent operation from initial contact with cylindrical object 78 through reforming of preformed flange 82 is shown in FIGS. 5–10. The first portion of inner rollers 64 to contact the inner surface of throat 80 is typically first tapered surface 72 as illustrated in FIGS. 5–6. Upon contact, the inner rollers 64, which are each freely rotatable on the inner surface of sidewall 90 of cylindrical object 78, are rotated around the inner circumference of throat 80 by driven rotation of inner mounting assembly 14. As apparatus 10 is linearly advanced into cylindrical object 78, as best illustrated in FIG. 7, throat 80 will be resized as a result of being forced outward by first angled surface 72 and/or second angled surface 74. In addition, the concentric rotation of inner rollers 64 about the rotational axis of inner mounting assembly 14 will also improve the circularity of throat 80.

Figure 8:
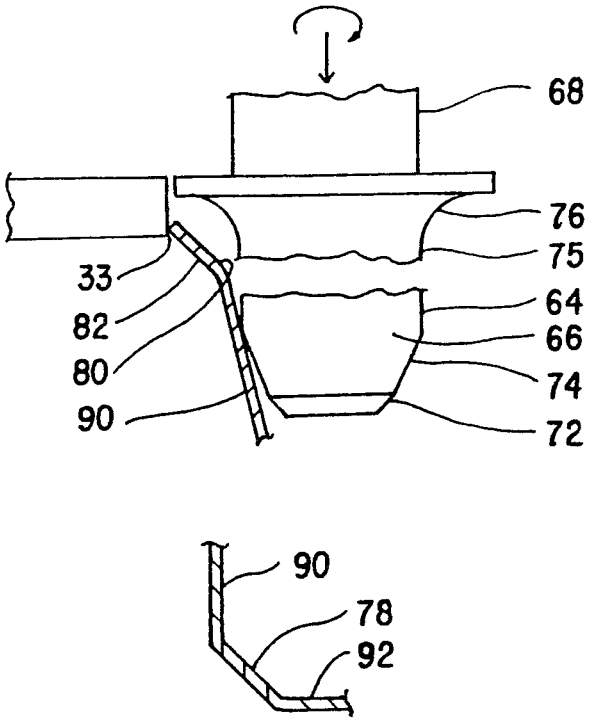
FIG. 8 is an enlarged side view of the inner roller after it has further inwardly advanced into the necked container to establish contact between at least portions of the outer edge of the preformed flange and a radial restraining device of the present invention.
Figure 9:
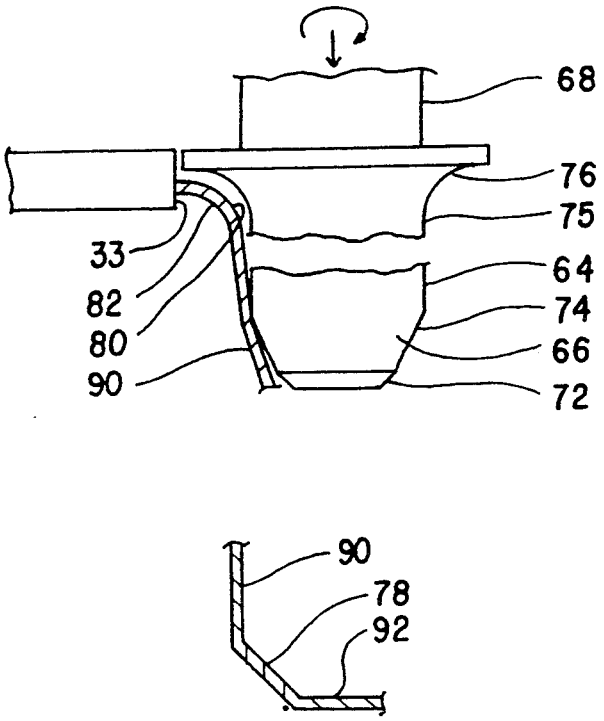
FIG. 9 is an enlarged side view of the inner roller after it has further inwardly advanced into the necked container, the preformed flange having slightly flexed upward.
Figure 10:
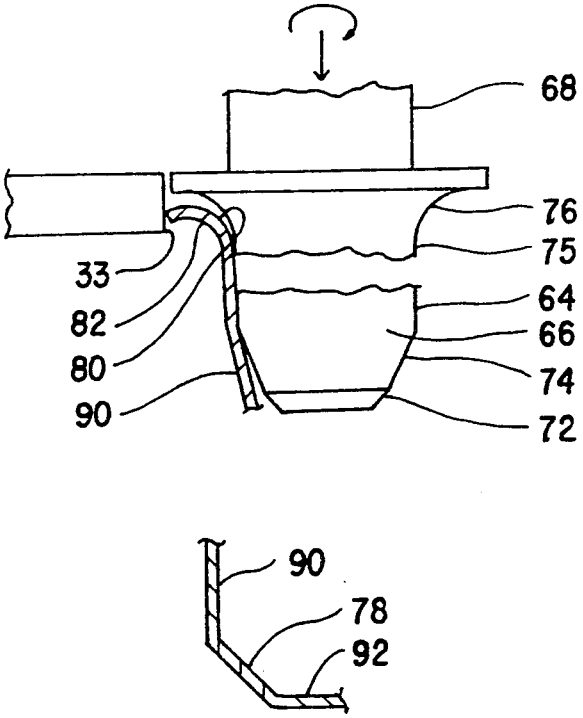
FIG. 10 is an enlarged side view of the inner roller after it has completed its advance into the container, whereby the flange has further flexed upward, the flange has assumed a greater angular relationship relative to the container center axis for end-piece securement, and the flange edge has been turned slightly downward.

After the apparatus 10 has further advanced within the cylindrical object 78, edge portions of the preformed flange 82 corresponding with the widest portions of preformed flange 82 will contact, in an upwardly angular manner, the axially progressing radial restraining ring 33 which limits further outward movement thereof as illustrated in FIGS. 8–10. As the inward progression of the inner rollers 64 continues, the edge of preformed flange 82 may slightly move up the face of the radial restraining ring 33, and in any case (as shown in FIGS. 9 and 10) at least the widest portions of the preformed flange 82 will flex in an upward manner. In this regard, it is noted that the skirt-like bases 76 of the rollers 64 accommodate such flexure in the illustrated embodiment. Additional rotation and axial motion of inner rollers 64 and restriction of radial movement by the axially progressing radial restraining ring 33 will serve to further improve the concentricity of throat 80 with respect to the outer edge of preformed flange 82, to bend the preformed flange 82 downward into a position for end-piece engagement, and to further improve the uniformity and width of preformed flange 82. Again, such improvements will result in large part due to the compensating upward flexure of the flange to differing degrees about the periphery thereof. As previously noted, preformed flange 82 uniformity may be further contributed to by preformed flange 82 edge reformation in a downward direction as shown in FIG. 10.

While various embodiments of the present invention have been described in great detail, it is apparent that lo modifications and adaptations of these embodiments will occur to those skilled in the art. It is to be expressly understood that such modifications and adaptations are within the spirit and scope of the present invention as set forth in the claims which follow.

What is claimed is:

1. A method for reforming a preformed flange at an open end of a container near a throat of the container, wherein the open end opens in a first direction, wherein the preformed flange extends obliquely outward in the first direction relative to the throat and has an outer edge, and wherein the throat has a first diameter, comprising the steps of:

resizing said throat to a second diameter greater than said first diameter by applying an outward force to the throat;

restraining outward radial movement of at least a portion of said outer edge of said preformed flange during a portion of said resizing step; and flexing at least portions of said preformed flange between said throat and said restrained portion of said outer edge during at least a portion of said restraining step, wherein the flexed portions project to differing degrees in said first direction, and wherein at least a portion of the projecting flexure is maintained after the flexing step to improve uniformity of linear distances between points on the throat and radially aligned points on the outer edge.

2. The method of claim 1, wherein first portions of said preformed flange which are wider than second portions of the preformed flange project to a greater degree than said second portions of the preformed flange.

3. The method of claim 1, said resizing step comprising:

providing a first assembly having a plurality of tapered rollers adjacent to said open end of said container;

rotating said first assembly relative to said container; and advancing said first assembly axially into said throat of said container, wherein said tapered rollers contact and rotate relative to the throat to force said preformed flange of the container radially outward.

4. The method of claim 3, wherein said rotating rollers substantially define a conic resizing means having a central, longitudinal axis substantially aligned with a central, longitudinal axis of said container.

5. The method of claim 3, said restraining step comprising:

providing a second assembly having an inner surface positioned about said first assembly; and contacting at least a portion of said inner surface of said second assembly with at least a portion of said outer edge of said preformed flange of said container during said advancing step of said resizing step.

6. The method of claim 5, wherein said inner surface of said second assembly is substantially cylindrical and has a central longitudinal axis substantially aligned with a central, longitudinal axis of said container, wherein the circularity of said outer edge of said flange is improved.

7. The method of claim 5, said restraining step further comprising the following step:

advancing said second assembly axially relative to said container, wherein said flange angle is increased into a position for attachment of an end piece thereto.

8. The method of claim 7, wherein said axial advance of said first assembly and said axial advance of said second assembly are at least partially simultaneous.

9. An apparatus for reforming a preformed flange at an open end of a container near a throat of the container, wherein the open end opens in a first direction, wherein the preformed flange has an initial width, extends obliquely outward in the first direction relative to the throat, and has an outer edge, and wherein the throat has a first diameter, comprising:

throat resizing means for increasing the diameter of said throat from said first diameter to a second diameter by exerting an outward force on the throat; and restraining means, positioned radially outward from said throat resizing means, for restraining outward radial movement of at least a portion of said outer edge of said preformed flange produced by said throat resizing means, wherein during use the preformed flange engages said restraining means in an angular manner and at least a portion of the preformed flange flexes between said throat and said restrained portion of said outer edge, the flexed portions projecting in differing degrees in said first direction, whereby at least a portion of the projecting flexure is maintained to improve uniformity of distances between points on the throat and radially aligned points on the outer edge.

10. The apparatus of claim 9, further including axial restraining means, wherein said axial restraining means deflects said preformed flange toward said restraining means and is shaped and positioned relative to said throat resizing means and the restraining means to accommodate for projection of said flexed portions in said first direction.

11. The apparatus of claim 9, wherein said throat resizing means includes a rotational driving means which imparts relative rotational motion between the throat resizing means and said container and a linear driving means which imparts relative linear motion between the throat resizing means and the container.

12. The apparatus of claim 9, wherein said throat resizing means exerts an axial and radial force on said throat of said container.

13. The apparatus of claim 9, wherein said throat resizing means includes a plurality of rotatable rollers.

14. The apparatus of claim 13, wherein at least one of said rollers has a tapered surface which contacts said container.

15. The apparatus of claim 13, wherein said rollers are concentrically positioned relative to a central, longitudinal axis of said container.

16. The apparatus of claim 13, wherein at least a portion of a surface of said rollers deflects said preformed flange toward said restraining means.

17. The apparatus of claim 13, wherein said rollers are freely and rotatably connected to a housing, wherein said housing has a rotational axis substantially aligned with a central, longitudinal axis of said container and wherein the rollers are concentrically positioned about the rotational axis of the housing.

18. The apparatus of claim 9, wherein said radial restraining means has a cylindrical surface which is substantially parallel to a central, longitudinal axis of said container.

19. A method for reforming a preformed flange at an open end of a container near a throat of the container, wherein the open end opens in a first direction, wherein the preformed flange has an initial width, an outer edge, and extends obliquely outward in the first direction relative to the throat, and wherein the throat has a first diameter, comprising the steps of:

providing a first assembly having a plurality of tapered rollers adjacent to said open end of said container, wherein said first assembly has a rotational axis substantially aligned with a central, longitudinal axis of said container and wherein the rollers are concentrically positioned thereabout;

rotating said first assembly relative to said container;

advancing said first assembly axially into said throat of said container, wherein said tapered rollers contact and rotate relative to the throat to force said preformed flange radially outward;

providing a second assembly having an inner surface positioned about said first assembly and traveling axially therewith, wherein said inner surface is substantially cylindrical and has a central, longitudinal axis substantially aligned with said central, longitudinal axis of said container;

engaging at least a portion of said outer edge of said preformed flange with said inner surface of said second assembly, wherein said engaged portions initially contact the inner surface at an angle;

altering the angular relationship of said engaged portions of said preformed flange by restraining the outward radial movement of the preformed flange with said inner surface during the said advancing step;

flexing at least portions of said preformed flange between said throat and said engaged portion of said outer edge during at least a portion of said engaging and altering step, wherein the flexed portions project to differing degrees in said first direction, and wherein at least a portion of the projecting flexure is maintained after the flexing step to improve uniformity of linear distances between points on the throat and radially aligned points on the outer edge.

* * * * *

UNITED STATES PATENT AND TRADEMARK OFFICE

CERTIFICATE OF CORRECTION

PATENT NO. : 5,121,621

DATED : June 16, 1992

INVENTOR(S) : IHLY

It is certified that error appears in the above-identified patent and that said Letters Patent is hereby corrected as shown below:

Column 10, line 6, please delete "lo".

Signed and Sealed this

Fourteenth Day of September, 1993

Bruce Lehman

*Attest:*

BRUCE LEHMAN

*Attesting Officer*

*Commissioner of Patents and Trademarks*